US006116342A

United States Patent [19]

Clark et al.

[11] Patent Number: 6,116,342

[45] Date of Patent: Sep. 12, 2000

[54] METHODS OF PREVENTING WELL FRACTURE PROPPANT FLOW-BACK

[75] Inventors: Michael Dale Clark, Marlow, Okla.; Patrick L. Walker, Houston, Tex.; Kirk Lynn Schreiner; Philip D. Nguyen, both of Duncan, Okla.

[73] Assignee: Halliburton Energy Services, Inc., Duncan, Okla.

[21] Appl. No.: 09/175,603

[22] Filed: Oct. 20, 1998

[51] Int. Cl.[7] ..... E21B 43/267

[52] U.S. Cl. ..... 166/280; 166/665

[58] Field of Search ..... 166/280, 308, 166/66.5

[56] References Cited

U.S. PATENT DOCUMENTS

| | | | |
|---|---|---|---|
| 4,222,444 | 9/1980 | Hamilton | 166/66.5 |
| 5,439,055 | 8/1995 | Card et al. | 166/280 |
| 5,570,743 | 11/1996 | Padgett et al. | 166/285 |
| 5,908,073 | 6/1999 | Nguyen et al. | 166/280 |

FOREIGN PATENT DOCUMENTS

| | | | |
|---|---|---|---|
| 0754347 | 8/1980 | U.S.S.R. | 166/280 |

*Primary Examiner*—William Neuder
*Attorney, Agent, or Firm*—Robert A. Kent

[57] ABSTRACT

Improved methods of propping a fracture in a subterranean zone whereby the subsequent flow-back of the proppant is prevented are provided. The methods basically comprise the steps of placing proppant and a magnetized material in said fracture while maintaining the fracture open and then allowing the fracture to close on the proppant and magnetized material whereby the magnetized material clusters in voids and channels in the proppant bed formed.

17 Claims, No Drawings

METHODS OF PREVENTING WELL FRACTURE PROPPANT FLOW-BACK

BACKGROUND OF THE INVENTION

1. Field of the Invention

The present invention relates generally to improved methods of preventing well fracture proppant flow-back.

2. Description of the Prior Art

Oil and gas wells are often stimulated by hydraulically fracturing subterranean producing zones penetrated thereby. In such hydraulic fracturing treatments, a viscous fracturing fluid is pumped into the zone to be fractured at a rate and pressure such that one or more fractures are formed and extended in the zone. A solid particulate material for propping the fractures open, commonly referred to as "proppant", is suspended in a portion of the fracturing fluid so that the proppant is deposited in the fractures when the viscous fracturing fluid is caused to revert to a thin fluid and returned to the surface. The proppant functions to prevent the fractures from closing and to form a permeable proppant bed between the fracture faces through which produced fluids can readily flow.

In order to prevent the subsequent flow-back of the proppant as well as subterranean formation particulate solids with fluids produced from the fractured zone, at least a portion of the proppant has heretofore been coated with a hardenable resin composition and consolidated into a hard permeable mass. Typically, the resin composition coated proppant is deposited in the fractures after a large quantity of uncoated proppant material has been deposited therein. That is, the last portion of the proppant deposited in each fracture, referred to in the art as the "tail-in" portion, is coated with a hardenable resin composition. Upon the hardening of the resin composition, the tail-in portion of the proppant is consolidated into a hard permeable mass having a high compressive strength whereby unconsolidated proppant and formation particulate solids are prevented from flowing out of the fractures with produced fluids. While this technique has been successful, the high costs of the hardenable resin composition and the mixing and proppant coating procedures utilized have contributed to making the cost of the fracturing procedure very high.

Thus, there is a continuing need for improved methods of fracturing and placing proppant in subterranean zones whereby the flow-back of the proppant with produced fluids is prevented.

SUMMARY OF THE INVENTION

The present invention provides improved methods of propping one or more fractures in a subterranean zone whereby the subsequent flow-back of proppant with produced fluids is prevented. The methods are basically comprised of the steps of placing proppant and a magnetized material in the fractures while maintaining the fractures open and then allowing the fractures to close on the proppant and magnetized material therein.

The magnetized material is comprised of a magnetizable metal which can be in the form of beads, fibers, strips, particles or the like, or the metal can be embedded in or coated on a non-metallic material. After a fracture in which the proppant and magnetized material are placed closes and fluids are produced from the subterranean zone by way of the proppant bed therein, the magnetized material moves to voids or channels located within the proppant bed through which both deposited proppant and natural formation particulate solids flow out of the fracture. The magnetized material forms clusters which are held together by magnetic attraction in the voids or channels which in turn facilitate the formation of permeable proppant bridges therein. The magnetized material-proppant bridges retard and ultimately prevent the flow-back of proppant and formation solids, but still allow production of oil and/or gas through the fracture at sufficiently high rates.

It is, therefore, a general object of the present invention to provide improved methods of propping a fracture in a subterranean zone whereby the subsequent flow-back of the proppant with produced fluids is prevented.

Other and further objects, features and advantages of the present invention will be readily apparent to those skilled in the art upon a reading of the description of preferred embodiments which follows.

DESCRIPTION OF PREFERRED EMBODIMENTS

The formation and propping of fractures in a subterranean zone utilizing hydraulic fracturing techniques are well known to those skilled in the art. The hydraulic fracturing process generally involves pumping a viscous fracturing fluid, a portion of which contains suspended proppant, into the subterranean zone by way of the well bore penetrating it at a rate and pressure whereby one or more fractures are created in the zone. The continued pumping of the fracturing fluid extends the fractures in the formation and carries proppant into the fractures. Upon the reduction of the flow of fracturing fluid and pressure exerted on the formation along with the breaking of the viscous fracturing fluid into a thin fluid, the proppant is deposited in the fractures and the fractures are prevented from closing by the proppant therein. That is, after the proppant is placed in the fractures, the fractures are allowed to close on the proppant whereby conductive proppant beds are formed in the fractures through which formation fluids can be produced at sufficiently high rates. However, if the proppant beds include or develop voids or channels therein, proppant flow-back with produced fluids takes place. Such proppant flow-back is highly undesirable in that as the proppant flows through tubular goods and production equipment, it erodes the metal surfaces of the tubular goods and equipment, plugs and erodes valves and generally increases the problems and costs involved in producing wells. In unconsolidated formations where formation particulate solids flow with the produced fluids through the voids and channels in the proppant beds, the problems and costs are compounded.

The improved methods of the present invention for propping a fracture in a subterranean zone whereby the subsequent flow-back of the proppant with produced fluids is prevented basically comprise the steps of placing proppant and a magnetized material in the fracture while maintaining the fracture open and then allowing the fracture to close on the proppant and magnetized material whereby a permeable proppant bed containing magnetized material is formed. If the proppant bed includes or develops voids or channels therein, the magnetized material forms magnetically attracted clusters in the voids or channels which promote the formation of proppant bridges and ultimately prevent the flow-back of proppant and formation solids while still allowing the production of oil and/or gas through the fracture at sufficiently high rates.

The improved methods of the present invention for fracturing a subterranean zone penetrated by a well bore and placing proppant therein whereby the flow-back of the proppant and formation solids with produced fluids is prevented comprises the steps of pumping a fracturing fluid into the subterranean zone by way of the well bore at a sufficient rate and pressure to form at least one fracture in the zone, placing the proppant and a magnetized material in the fracture while maintaining the fracture open, and then allowing the fracture to close on the proppant and magnetized material whereby the magnetized material clusters by magnetic attraction in voids and channels formed or developed in the proppant bed which facilitates the formation of proppant bridges therein and prevents proppant and formation solids flow-back.

Fracturing fluids which can be utilized in accordance with the present invention include gelled water or oil base liquids, foams and emulsions. The foams utilized have generally been comprised of water based liquids containing one or more foaming agents foamed with a gas such as nitrogen or air. Emulsions formed with two or more immiscible liquids have also been utilized. A particularly useful emulsion for carrying out formation fracturing procedures is comprised of a water based liquid and a liquified, normally gaseous fluid such as carbon dioxide. Upon pressure release, the liquified gaseous fluid vaporizes and rapidly flows out of the formation.

The most common fracturing fluid utilized heretofore which is generally preferred for use in accordance with this invention is comprised of water, a gelling agent for gelling the water and increasing its viscosity, and optionally, a cross-linking agent for cross-linking the gel and further increasing the viscosity of the fluid. The increased viscosity of the gelled or gelled and cross-linked fracturing fluid reduces fluid loss and allows the fracturing fluid to transport significant quantities of suspended proppant and magnetized material into the created fractures.

The water utilized to form the fracturing fluids used in accordance with the methods of this invention can be fresh water, salt water, brine or any other aqueous liquid which does not adversely react with other components of the fracturing fluids.

A variety of gelling agents can be utilized including hydratible polymers which contain one or more of the functional groups such as hydroxyl, cis-hydroxyl, carboxymethyl, sulfate, sulfonate, amino or amide. Particularly useful such polymers are polysaccharides and derivatives thereof which contain one or more of the monosaccharide units galactose, mannose, glucoside, glucose, xylose, arabinose, fructose, glucuronic acid or pyranosyl sulfate. Natural hydratable polymers containing the foregoing functional groups and units include guar gum and derivatives thereof, locust bean gum, tara, konjak, tamarind, starch, cellulose and derivatives thereof, karaya, xanthan, tragacanth and carrageenan. Hydratible synthetic polymers and copolymers which contain the above mentioned functional groups and which have been utilized heretofore include polyacrylate, polymethacrylate, polyacrylamide, maleic anhydride, methylvinyl ether polymers, polyvinyl alcohol and polyvinylpyrrolidone.

Examples of cross-linking agents which can be utilized to further increase the viscosity of the gelled fracturing fluid are multivalent metal salts or other compounds which are capable of releasing multivalent metal ions in an aqueous solution. Examples of the multivalent metal ions are chromium, zirconium, antimony, titanium, iron (ferrous or ferric), zinc or aluminum. The above described gelled or gelled and cross-linked fracturing fluids can also include gel breakers such as those of the enzyme type, the oxidizing type or the acid buffer type which are well known to those skilled in the art. The gel breakers cause the viscous fracturing fluids to revert to thin fluids that can be produced back to the surface after they have been used to create and prop fractures in a subterranean zone.

The proppant and magnetized material utilized in accordance with this invention are suspended in a portion of the viscous fracturing fluid so that the proppant and magnetized material are placed in the formed fractures in a subterranean zone. Thereafter, the fracturing fluid flow and pressure exerted on the fractured subterranean zone are terminated whereby the fractures are allowed to close on the proppant and magnetized material whereby permeable proppant beds are formed in the fractures. The suspension of the proppant and magnetized material in the fracturing fluid can be accomplished by utilizing conventional batch mixing techniques to mix and suspend the proppant and magnetized material, or one or both of the proppant and magnetized material can be injected into the fracturing fluid on-the-fly.

As mentioned above, the magnetized material is basically comprised of a magnetizable metal selected from the group consisting of iron, ferrite, low carbon steel, iron-silicon alloys, nickel-iron alloys, iron-cobalt alloys and other similar magnetizable metals. The magnetizable metals can be utilized by themselves in the form of beads, fibers, strips, shavings, small pieces of irregular shape and particles. Alternatively, the magnetizable metal can be embedded in a particulate non-metallic material such as plastics, resins, ceramics or other suitable materials, or the magnetizable metal can be coated in powdered form on the outside surfaces of such materials.

The magnetizable metal in the magnetized material can be premagnetized or the magnetizable metal making up or included in the magnetized material can be passed through a magnetic field whereby it is magnetized just prior to combining the magnetized material with the proppant utilized and suspending the proppant and magnetized material in the fracturing fluid used. In an alternate technique, a magnetic field can be provided downhole at the location of the zone to be fractured so that the magnetizable metal is magnetized just prior to entering the fractures. The magnetic field can be supplied by electromagnets placed in the well bore near the perforations or by electronically magnetizing the casing itself. In order to prevent the magnetized material from magnetically attaching to the casing or a liner in the well bore before entering the fractured zone, the fracturing fluid containing the magnetized material can be pumped at a sufficient rate to erode or scour any attached magnetized material from the walls of the casing or liner. The individual magnetized material particles, beads, fibers or other individual pieces can optionally also be encapsulated with a material which is subsequently dissolvable by produced fluids to reduce the tendency of the magnetized material to attach to the casing or liner during transport.

As mentioned, the proppant utilized can be formed of various materials including, but not limited to, sand, bauxite, resins, ceramics, glass, plastics and the like. Generally, the proppant has a particle size in the range of from about 2 to about 400 mesh, U.S. Sieve Series. The preferred particulate material is sand having a particle size in the range of from about 10 to about 70 mesh, U.S. Sieve Series. Preferred sand and particle size distribution rates are one or more of 10–20 mesh, 20–40 mesh, 40–60 mesh or 50–70 mesh depending on the particular size and distribution of the formation solids to be screened out by the proppant.

The magnetized material utilized with a particular size proppant is preferably of the same similar size as the proppant in order to insure that the proppant bed containing the magnetized material has sufficient permeability. Generally, the magnetized material is included in a fracture or fractures with the proppant utilized in an amount in the range of from about 0.1% to about 25% by weight of the proppant. The preferrable amount of magnetic material ranges from 1% to 5% by weight of proppant. Depending upon the particular application involved, the magnetized material can be placed in the fractures after the proppant has been placed therein, i.e., as a tail-in portion, or it can be placed in the fractures intermittently with the proppant or mixed with the proppant. When a mixture of the proppant and magnetized material is placed in a fracture, the quantitative ratio of magnetized material to proppant is preferably increased as the mixture is placed.

As is understood by those skilled in the art, the fracturing fluid utilized in accordance with this invention can include one or more of a variety of well known additives such as gel stabilizers, fluid loss control additives, clay stabilizers, friction reducing additives, bactericides and the like.

Thus, the present invention is well adapted to carry out the objects and attain the benefits and advantages mentioned as well as those which are inherent therein. While numerous changes can be made by those skilled in the art, such changes are encompassed within the spirit of this invention as defined by the appended claims.

What is claimed is:

1. An improved method of propping a fracture in a subterranean zone with proppant whereby the subsequent flow-back of the proppant with produced fluids is prevented comprising the steps of:

(a) placing proppant and a magnetized material in said fracture while maintaining said fracture open to form a proppant bed, said magnetized material being embedded in or coated on a non-metallic material; and (b) allowing said fracture to close on said proppant and magnetized material whereby the magnetized material clusters in voids and channels in the proppant bed formed which facilitates creation of proppant bridges therein and prevents proppant flow-back.

2. The method of claim 1 wherein said magnetized material is comprised of a magnetizable metal selected from the group consisting of iron, ferrite, low carbon steel, iron-silicon alloys, nickel-iron alloys and iron-cobalt alloys.

3. The method of claim 1 wherein said non-metallic material is selected from the group consisting of plastics, resins ceramics, bauxite, sand and glass.

4. The method of claim 1 wherein said proppant is comprised of a particulate material selected from the group consisting of sand, bauxite, ceramics, glass, plastics and resins.

5. The method of claim 1 wherein said proppant and magnetized material are placed in said fracture intermittently.

6. The method of claim 1 wherein said proppant and magnetized material are placed in said fracture in the form of a mixture.

7. The method of claim 6 wherein the quantitative ratio of magnetized material to proppant in said mixture increases as said mixture is placed in said fracture.

8. The method of claim 1 wherein said proppant is placed in said fracture first followed by said magnetized material.

9. An improved method of fracturing a subterranean zone penetrated by a well bore and placing proppant therein whereby flow-back of proppant and formation particulate solids from the zone is prevented comprising:

(a) pumping a fracturing fluid into said subterranean zone by way of said well bore at a sufficient rate and pressure to form at least one fracture in said zone;

(b) placing said proppant and a magnetized material, embedded in or coated on a non-metallic material in said fracture while maintaining said fracture open to form a proppant bed; and (c) allowing said fracture to close on said proppant and magnetized material whereby said magnetized material clusters in voids and channels in the proppant bed formed which facilitates creation of proppant bridges therein and prevents proppant and solids flow-back.

10. The method of claim 9 wherein said magnetized material is comprised of a magnetizable metal selected from the group consisting of iron, ferrite, low carbon steel, iron-silicon alloys, nickel-iron alloys and iron-cobalt alloys.

11. The method of claim 9 wherein said non-metallic material is selected from the group consisting of plastics, resins ceramics, bauxite, sand and glass.

12. The method of claim 9 wherein said proppant is comprised of a particulate material selected from the group consisting of sand, bauxite, ceramics, glass, plastics and resins.

13. The method of claim 9 wherein said proppant and magnetized material are placed in said fracture in the form of a mixture.

14. The method of claim 9 wherein said proppant is placed in said fracture first followed by said magnetized material.

15. An improved method of propping a fracture and preventing undesired particulate flow through a fracture in a subterranean formation comprising:

introducing particles of non-metallic carrier material having associated therewith a magnetizable metal into a fracture in a subterranean formation; and magnetizing said magnetizable metal whereby the particles of non-metallic carrier material associated therewith form clusters by attraction of said magnetized metal in said fracture to facilitate prevention of particulate flow through said fracture.

16. The method of claim 15 wherein said magnetizable metal is selected from the group consisting of iron, ferrite, low carbon steel, iron-silicon alloys, nickel-iron alloys and iron-cobalt alloys.

17. The method of claim 15 wherein said magnetizable metal is embedded in or coated on said non-metallic carrier.

* * * * *